US012161926B2

(12) United States Patent
Baston

(10) Patent No.: US 12,161,926 B2
(45) **Date of Patent: *Dec. 10, 2024**

(54) SPORTS TRAINING SYSTEM

(71) Applicant: Maceo Baston, Bloomfield Hills, MI (US)

(72) Inventor: Maceo Baston, Bloomfield Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/350,973

(22) Filed: Jul. 12, 2023

(65) Prior Publication Data

US 2023/0347225 A1 Nov. 2, 2023

Related U.S. Application Data

(63) Continuation of application No. 17/351,415, filed on Jun. 18, 2021, now Pat. No. 11,771,972.
(Continued)

(51) Int. Cl.
*A63B 69/36* (2006.01)
*A63B 24/00* (2006.01)
(Continued)

(52) U.S. Cl.
CPC ..... *A63B 69/0071* (2013.01); *A63B 24/0062* (2013.01); *A63B 71/0622* (2013.01);
(Continued)

(58) Field of Classification Search
CPC ..... A63B 69/0071; A63B 24/0062; A63B 71/0622; A63B 2071/0661; A63B 2214/00; A63B 2220/803; A63B 2220/836; A63B 2225/50; A63B 24/0003; A63B 2024/0012; A63B 2024/0068; A63B 2071/0625; A63B 2071/0655; A63B 2209/10;
(Continued)

(56) References Cited

U.S. PATENT DOCUMENTS 3,344,436 A 10/1967 Stubbs
3,835,472 A 9/1974 Duggins
(Continued)

OTHER PUBLICATIONS

Alexander M. and Way D., "Mechanics of the Basketball Free Throw", Biomechanics Laboratory, University of Manitoba.
(Continued)

*Primary Examiner* — Nini F Legesse
(74) *Attorney, Agent, or Firm* — Ward Law Office LLC; Jacob M. Ward

(57) ABSTRACT

A sports training device includes a glove with a main body. The main body has a palm portion and a back portion. The main body is configured to receive a hand of a user. A plurality of finger receptacles is disposed on the main body. Each finger receptacle of the plurality of finger receptacles has a proximal end disposed adjacent to the main body and a distal end disposed opposite the proximal end. The plurality of finger receptacles includes a thumb receptacle, a first finger receptacle, and a second finger receptacle. Each of the distal end of the thumb receptacle, the distal end of the first finger receptacle, and the distal end of the second finger receptacle are open. A sensor is disposed on the glove and is configured to monitor a release of an object to be thrown.

20 Claims, 7 Drawing Sheets

Related U.S. Application Data

(60) Provisional application No. 63/040,862, filed on Jun. 18, 2020.

(51) Int. Cl.
*A63B 69/00* (2006.01)
*A63B 71/06* (2006.01)

(52) U.S. Cl.
CPC ... *A63B 2071/0661* (2013.01); *A63B 2214/00* (2020.08); *A63B 2220/803* (2013.01); *A63B 2220/836* (2013.01); *A63B 2225/50* (2013.01)

(58) Field of Classification Search
CPC ..... A63B 2210/50; A63B 69/0059; A63B 2220/13; A63B 2220/16; A63B 2220/24; A63B 2220/801; A63B 71/148; A63B 2220/17; A63B 2225/09
USPC ..... 473/202, 205, 207, 212, 409, 450
See application file for complete search history.

(56) References Cited

U.S. PATENT DOCUMENTS

| | | | | |
|---|---|---|---|---|
| 4,488,726 | A | 12/1984 | Murray | |
| 4,738,447 | A | 4/1988 | Brown | |
| 5,733,201 | A | 3/1998 | Caldwell et al. | |
| 5,833,233 | A * | 11/1998 | Strug | A63B 69/0071 473/450 |
| 6,729,979 | B1 | 5/2004 | Sullivan | |
| 6,852,067 | B2 | 2/2005 | Limonadi | |
| 7,437,776 | B1 | 10/2008 | Brown | |
| 7,780,541 | B2 * | 8/2010 | Bauer | G06F 1/163 473/202 |
| 8,038,549 | B2 | 10/2011 | Vann | |
| 9,301,563 | B2 * | 4/2016 | Hardy | A41D 19/0031 |
| 9,415,288 | B2 * | 8/2016 | Peterson | A63B 69/0059 |
| 9,950,237 | B2 | 4/2018 | Kline et al. | |
| 11,771,972 | B2 * | 10/2023 | Baston | A63B 24/0062 473/450 |
| 2008/0189827 | A1 | 8/2008 | Bauer | |
| 2010/0311513 | A1 | 12/2010 | Hardage | |
| 2011/0130227 | A1 | 6/2011 | Chen | |
| 2014/0045629 | A1 | 2/2014 | Peterson | |
| 2014/0215684 | A1 * | 8/2014 | Hardy | G01L 5/228 2/160 |
| 2016/0169754 | A1 * | 6/2016 | Kowalewski | G01L 5/162 73/862.541 |
| 2017/0086519 | A1 | 3/2017 | Vigano | |
| 2018/0264337 | A1 * | 9/2018 | Logan | A61B 5/6806 |
| 2018/0352880 | A1 * | 12/2018 | Castle | A41D 19/0027 |
| 2019/0099123 | A1 * | 4/2019 | Zambriski | A61B 5/7445 |
| 2019/0101981 | A1 | 4/2019 | Elias et al. | |
| 2019/0179412 | A1 | 6/2019 | Penmatcha et al. | |

OTHER PUBLICATIONS

Solidshot, "SOLIDshot Basketball Smart Sleeve", video, https://www.youtube.com/watch?v=r-pqgUP6xRc.
Noah Basketball, "The Noah Shooting System", webpage, https://www.noahbasketball.com/product.
Zepp, webpage, https://www.zepp.com/about-us.
Adidas, "Soccer Balls", webpage, https://www.adidas.com/us/soccer-balls.
Beast, "Beast Sensor", webpage, Italy, https://thisisbeast.com/blogs/solutions/beastsensor.

* cited by examiner

SPORTS TRAINING SYSTEM

CROSS-REFERENCE TO RELATED APPLICATIONS

This application is a continuation of U.S. patent application Ser. No. 17/351,415, filed Jun. 18, 2021, which in turn claims the benefit of U.S. Provisional Application Ser. No. 63/040,862, filed on Jun. 18, 2020. The entire disclosures of the above applications are incorporated herein by reference.

FIELD

The present invention relates generally to a sports training device and, more particularly, to a sports training device to be worn on a hand of a user for monitoring a release of an object.

INTRODUCTION

This section provides background information related to the present disclosure which is not necessarily prior art.

Sports are an integral part of almost every society. Many people, young and old, amateur and professional, enjoy the competitive atmosphere and the physical health benefits provided by sports, and are always looking for ways to improve their game. While hard work and practice are certainly important with respect to improving performance of any task, there are many technical aspects of every sport that need to be understood and rehearsed in order to optimize training sessions and gain an edge above the competition.

For example, in many sports in which a ball or other sporting equipment must be held, thrown, and released, athletes must understand and practice an optimal way of holding, throwing, and releasing the ball in order to truly excel at their sport of choice. As one example, a number of factors go into perfecting a basketball shot including footwork, hand and wrist position and orientation, and grip and hand position relative to the basketball. The importance of perfecting these technical aspects of the game cannot be understated, and often athletes must practice very specific techniques in order to take their game to a most competitive level.

In basketball, for example, it is known to use different devices to help athletes acquire technical skills related to shooting the basketball and, after extensive practice, to perform the movements of the sport relying on muscle memory developed during use of those devices. In one example, as described in U.S. Pat. No. 7,437,776 to Brown, a basketball training glove adapted to maintain a position of the thumb relative to the index finger during a training session is described. In a related example, as described in U.S. Pat. No. 6,729,979 to Sullivan, a basketball shooting trainer device includes a wedge adapted to spread out the fingers of a user. However, existing devices fall short of addressing each technical element involved in holding, throwing, and releasing a ball or other sporting equipment, and do not provided useful feedback to the user that would allow the user to make corrections during the training session.

Accordingly, there is a continuing need for a sports training device that allows a user to focus on multiple technical aspects of holding, throwing, and releasing a ball or other sporting equipment during a training session. Desirably, the sports training device would be easy to wear, easy to clean, and provide useful feedback immediately after performing a specific task during a training session, as well as more detailed feedback for evaluation after a training session.

SUMMARY

In concordance with the instant disclosure, a sports training device that allows a user to focus on multiple technical aspects of holding, throwing, and releasing a ball or other sporting equipment during a training session, and that is easy-to-wear, easy to clean, and provides useful feedback immediately after performing a specific task during a training session, as well as more detailed feedback for evaluation after a training session, has surprisingly been discovered.

In certain embodiments, a sports training device to be worn on a hand of user includes a glove with a main body. The main body has a palm portion and a back portion. The main body is configured to receive the hand of the user. A plurality of finger receptacles is disposed on the main body. Each finger receptacle of the plurality finger receptacles has a proximal end disposed adjacent to the main body and a distal end disposed opposite the proximal end. The plurality of finger receptacles includes a thumb receptacle, a first finger receptacle, and a second finger receptacle. Each of the distal end of the thumb receptacle, the distal end of the first finger receptacle, and the distal end of the second finger receptacle are open. A sensor is disposed on the glove. The sensor is configured to monitor a release of an object by the hand of the user.

In certain embodiments, a sports training system to be worn on a hand of a user includes a glove with a main body. The main body has a palm portion and a back portion. The main body is configured to receive the hand of the user. A plurality of finger receptacles is disposed on the main body. Each finger receptacle of the plurality of finger receptacles has a proximal end disposed adjacent to the main body and a distal end disposed opposite the proximal end. The plurality of finger receptacles includes a thumb receptacle, a first finger receptacle, and a second finger receptacle. Each of the distal end of the thumb receptacle, the distal end of the first finger receptacle, and the distal end of the second finger receptacle are open. A sensor is disposed on the glove. The sensor is configured to monitor a release of an object by the hand of the user. The sports training system further includes a controller in communication with the sensor and a remote device adapted to receive a set of data from the controller.

In certain embodiments, a method of improving a release of an object comprises a first step of providing a sports training device to be worn on a hand of a user. The sports training device includes a glove with a main body. The main body has a palm portion and a back portion. The main body is configured to receive the hand of the user. A plurality of finger receptacles is disposed on the main body. Each finger receptacle of the plurality of finger receptacles has a proximal end disposed adjacent to the main body and a distal end disposed opposite the proximal end. The plurality of finger receptacles includes a thumb receptacle, a first finger receptacle, and a second finger receptacle. Each of the distal end of the thumb receptacle, the distal end of the first finger receptacle, and the distal end of the second finger receptacle are open. A sensor is disposed on the glove. The sensor is configured to monitor a release of an object to be thrown. A controller is in communication with the sensor. A second step includes putting the glove on the hand of the user. Additional steps can include one or more of: receiving, by the controller, a set of data from the sensor; determining, using the controller, if the set of data falls in a predetermined category, the predetermined category including an acceptable range and an unacceptable range; displaying whether the set of data is in the acceptable range or the unacceptable range to the user on the visual interface; activating an activation mechanism in communication with the controller; selecting a desired function of the sports training device to be used during a training session to collect and process data; performing a specific movement during a training session; collecting the data from the sensor during the specific movement; and evaluating the data on a visual interface of the glove.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 2:
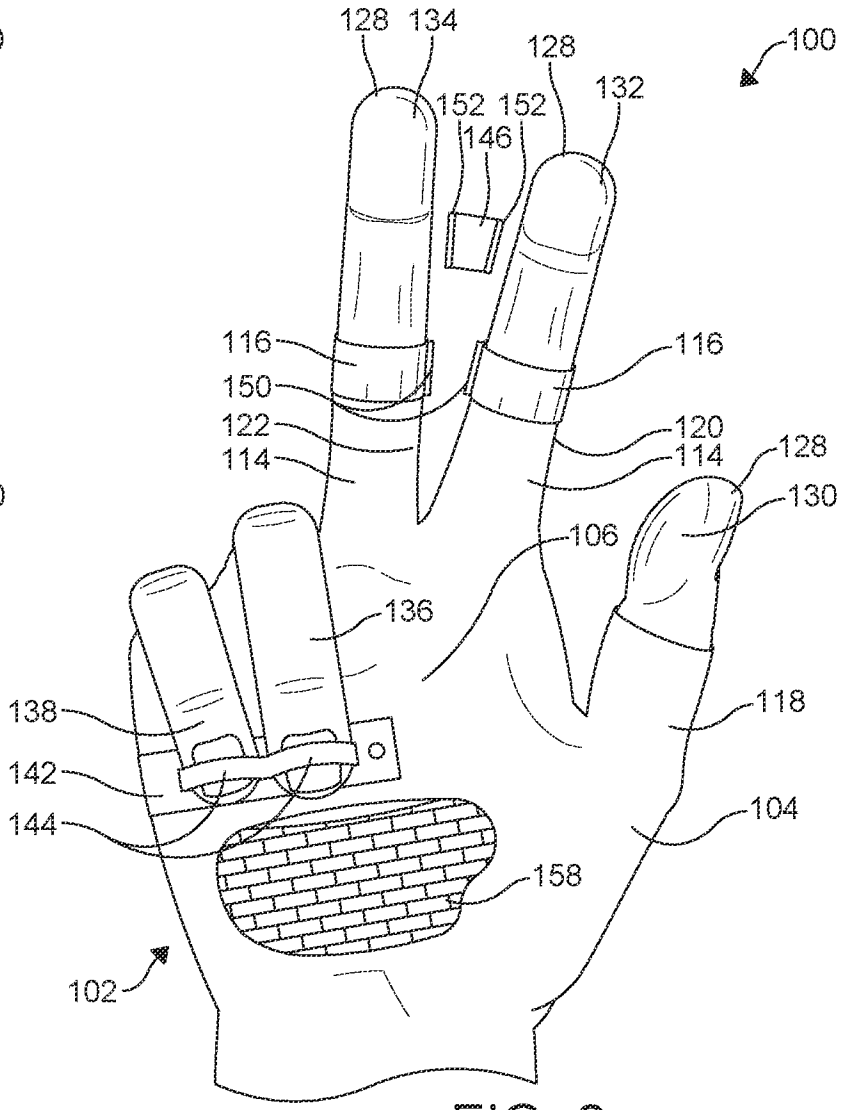
FIG. 2 is a rear elevational view of a sports training device according to another embodiment of the present disclosure.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
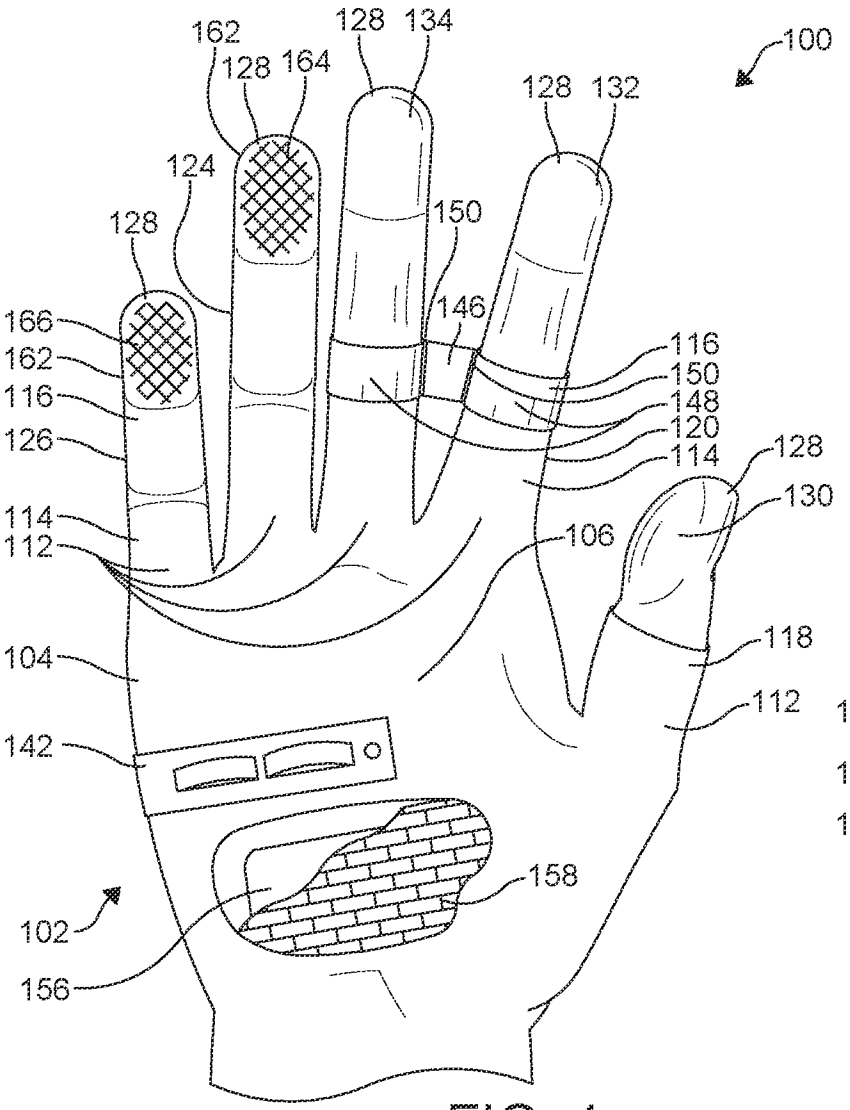
FIG. 1 is a rear elevational view of a sports training device according to one embodiment of the present disclosure.
Figure 3:
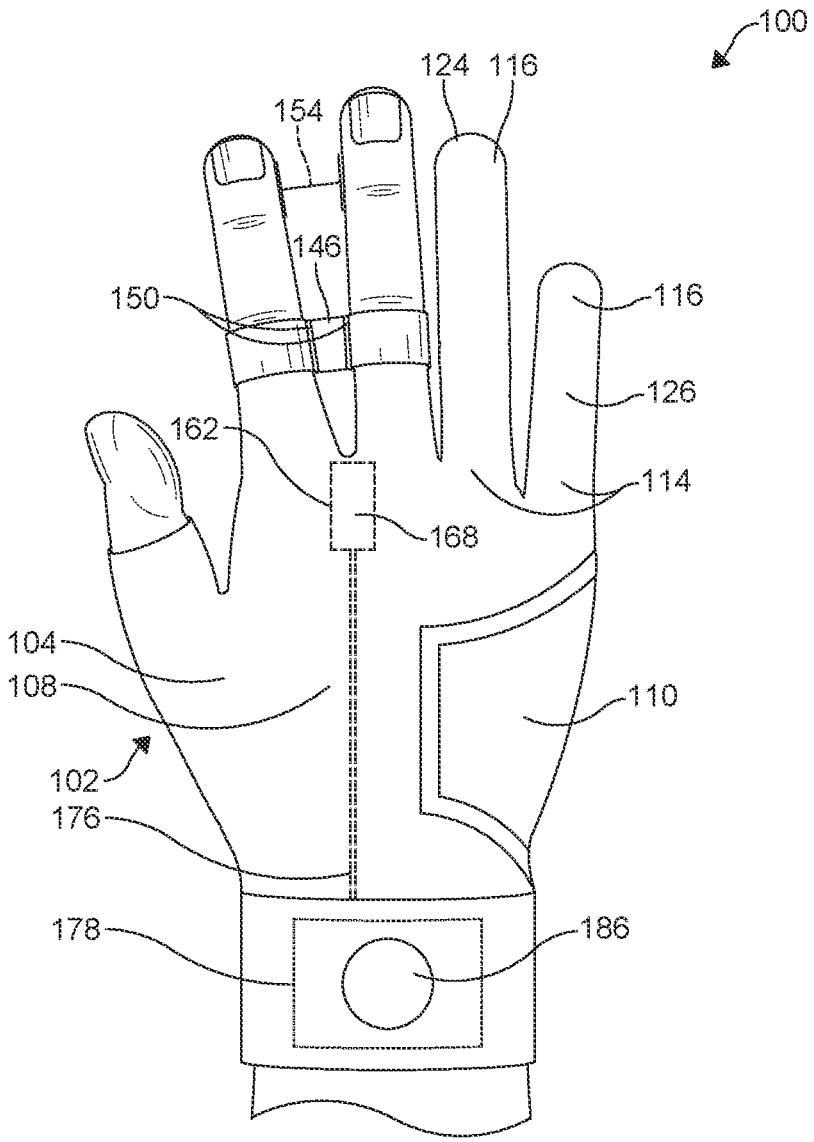
FIG. 3 is a front elevational view of a sports training device according to another embodiment of the present disclosure.

With reference to FIGS. 1-3, a sports training device 100 to be worn on a hand of a user is shown. The sports training device 100 may include a glove 102 according to certain embodiments of the present disclosure. The glove 102 may be configured to be worn on a shooting, throwing, or releasing hand of the user. Accordingly, the glove 102 is understood to be either left-handed or right-handed, as required by the user. In certain embodiments, however, the glove 102 may be adapted for use on both a left hand and a right hand of the user. The glove 102 may come in a variety of sizes for both adults and children. In certain embodiments, the glove 102 may be adjustable and flexible such that it may be worn on a range of hand sizes.

In certain embodiments, the glove 102 may be fabricated from a flexible, stretchable material. Desirably, the material may be lightweight, durable, easy to clean, and resistant to tears. According to certain embodiments, the material may have antimicrobial properties. As a non-limiting example, copper may be woven into the material in order to provide the antimicrobial properties. As another non-limiting example, in certain embodiments, the material of the glove 102 may be treated with an antimicrobial product. The material of the glove 102 may be a breathable material adapted to keep the user dry during activity, according to certain embodiments. Materials including cotton, spandex, elastane, nylon, polyester, polyester-vinyl, vinyl, and/or rayon may be used to fabricate the glove 102. The glove 102 may be formed using a solid panel of material, a material having one or more openings, a mesh material, or any desirable combination of materials, weaves of material, and openings. A skilled artisan may select any suitable material or combination of materials for the glove 102, as desired.

Figure 5B:
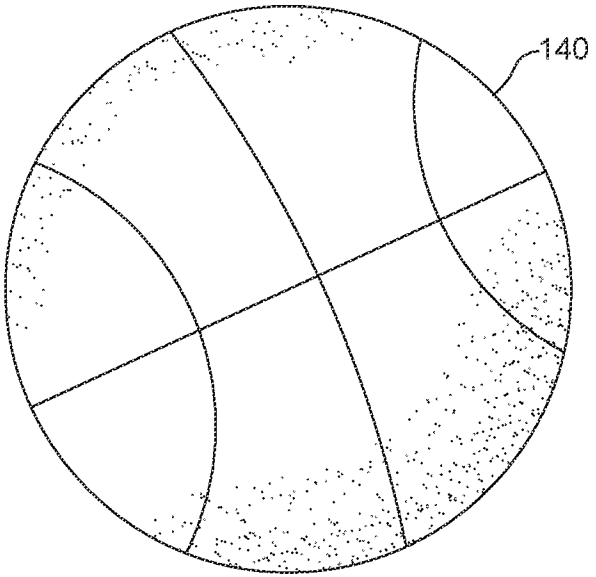
FIG. 5B is a side perspective view of a sports training device worn by a user according to another embodiment of the present disclosure.
Figure 5B:
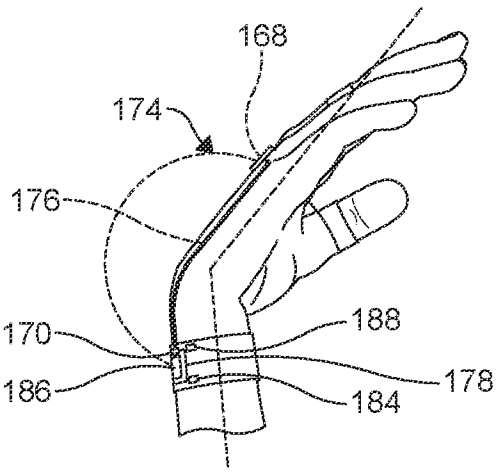
Figure 5A:
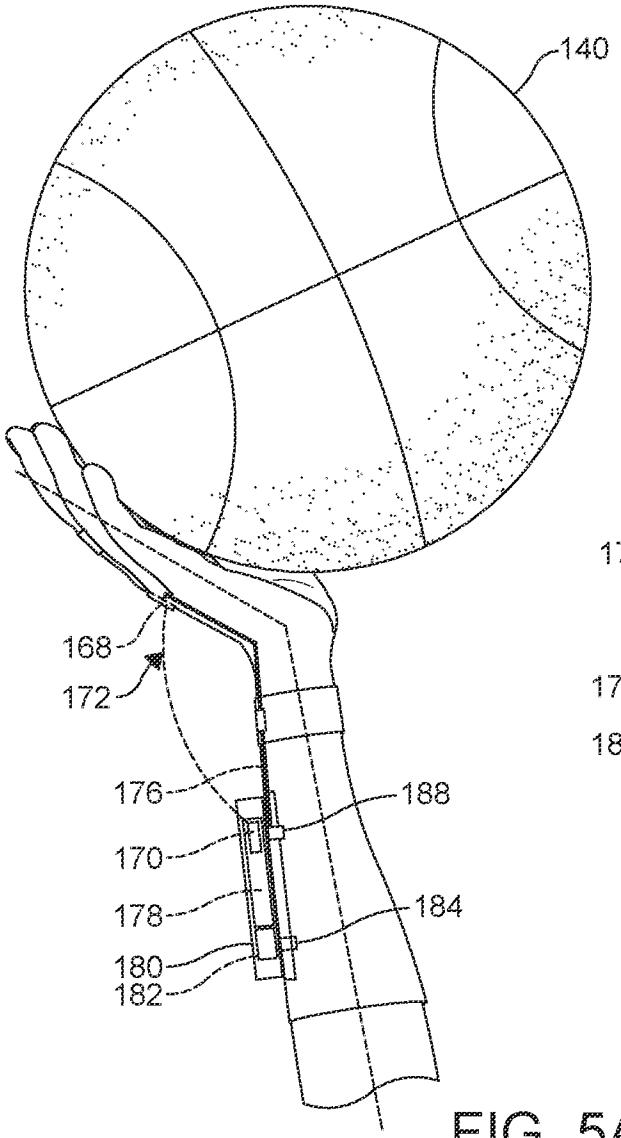
FIG. 5A is a side perspective view of a sports training device worn by a user according to another embodiment of the present disclosure.

In certain embodiments, and with renewed reference to FIGS. 1-3, the glove 102 may have a main body 104 defined by a palm portion 106 and a back portion 108. In one embodiment, as shown in FIGS. 3 and 5B, the main body 104 may be configured to receive the hand of the user and a wrist of the user. In another embodiment, as shown in FIG. 5A, the main body 104 may be configured to receive the hand of the user, the wrist of the user, and a forearm of the user. The main body 104 may have one or more fit adjusting mechanisms 110 for customizing and adjusting the size and fit of the glove 102 on the user's hand, wrist, and forearm. As non-limiting examples, an adjustable strap, flap, zipper, button, elastic element, hook-and-loop fastener, or tie may be used to tighten or more securely fasten and hold the glove 102 in place, as desired. Likewise, in certain embodiments, a gripping surface (not shown) or other textured surface may be disposed on or integral with one or more portions of the glove 102, for example, an inner surface (not shown) of the glove 102, in order to secure the glove 102 on the user's hand, wrist, and forearm.

In certain embodiments, the main body 104 may have one or more finger receptacles 112. Each finger receptacle 112 may be in communication with the main body 104 and configured to receive a finger of the user. Each finger receptacle 112 may have a proximal end 114 disposed adjacent to the palm portion 106 and back portion 108 of the glove 102, and a distal end 116 disposed opposite the proximal end 114. Each finger receptacle 112 may be integral with the glove 102 or removably connected to the glove 102.

In certain embodiments, the glove 102 may include a thumb receptacle 118, a first finger receptacle 120, a second finger receptacle 122, a third finger receptacle 124, and a fourth finger receptacle 126. In certain embodiments, each of the thumb receptacle 118, the first finger receptacle 120, and the second finger receptacle 122 may be open at the distal end 116. Accordingly, a tip 128 of each of a thumb 130 of the user, a first finger 132 of the user, and a second finger 134 of the user may be exposed when the glove 102 is worn, as shown in FIGS. 1 and 3, such that each of the tips 128 of the thumb 130 and the first and second fingers 132, 134 of the user may make direct contact with a ball 140 or other sporting equipment.

In certain embodiments, each of the third finger receptacle 124 and the fourth finger receptacle 126 may be closed at the distal end 116, such that a third finger 136 and a fourth finger 138 of the user do not make direct contact with the ball 140 or other sporting equipment. A skilled artisan may select any tip 128 of one or more of the thumb 130 and the first, second, third, and fourth fingers 132, 134, 136, 138 to be exposed or covered, as desired. In certain embodiments, a portion of each finger receptacle 112 or all of each finger receptacle 112 may be adjustable or removable, as determined by one with skill in the art.

It should be appreciated that certain embodiments of the sports training device 100 are specifically configured to train the user in a three-finger shooting method for basketball. Accordingly, in certain embodiments, it is particularly advantageous to allow only the thumb 130, the first finger 132, and the second finger 134 to contact the ball 140 during a training session. The glove 102 may allow the user to focus the training session on the three-finger shooting method. In other embodiments, one or more of the thumb receptacle 118 and the first, second, third, and fourth finger receptacles 120, 122, 124, 126 may be open, closed, or any combination of the two at the distal end 116 to accommodate other shooting, throwing, or releasing styles according to the desired end use of the glove 102.

In certain embodiments, the glove 102 may have a finger anchor 142, for example, as shown in FIGS. 1 and 2. The finger anchor 142 may be disposed on the palm portion 106 of the glove 102, or any other suitable portion of the glove 102, as desired. The finger anchor 142 may be integral with the glove 102 or permanently or removably connected to the glove 102. Any suitable element or combination of elements made from any suitable material or combination of materials may be used to form the finger anchor 142. As non-limiting examples, a strap, a snap or button, or a hook-and-loop connector may be used. In certain embodiments, the finger anchor 142 may be repositionable on different portions of the glove 102 or removable, as desired by the user. The finger anchor 142 may be adjustable to fit one or more of the thumb 130 and the first, second, third, and fourth fingers 132, 134, 136, 138.

In certain embodiments, the finger anchor 142 may be adapted to hold one or more of the user's thumb 130 and the first, second, third, and fourth fingers 132, 134, 136, 138 in a particular position during the training session. For example, the finger anchor 142 may be used to secure one or more of the user's the thumb 130 and the first, second, third, and fourth fingers 132, 134, 136, 138 in a position that is not in contact with the ball 140 or other sporting equipment during use of the glove 102.

In a more particular embodiment, the finger anchor 142 may include one or more loops 144 disposed adjacent to the proximal end 114 of each of the third finger receptacle 124 and the fourth finger receptacle 126. Each loop 144 may be configured to selectively receive one of the third finger 136 and the fourth finger 138, for example, as shown in FIG. 2. The user may insert the third finger 136 and the fourth finger 138 through the loops 144 of the finger anchor 142, thereby securing the third finger 136 and the fourth finger 138 in a position away from the ball 140 or other sporting equipment during use. Advantageously, the finger anchor 142 may be used to ensure that the user is using only the desired fingers during the training session. In a more specific embodiment, the user may only use the thumb 130, the first finger 132, and the second finger 134 during a training session, as a non-limiting example. It should be appreciated that any finger anchor 142 adapted to anchor and secure one or more of the user's fingers in a desired position based on a particular end use of the glove 102 may be used, as determined by one of skill in the art.

With renewed reference to FIGS. 1-3, the glove 102 may be configured to receive a wedge 146. The wedge 146 may be adapted to position the hand or a portion of the hand of the user in a desired position. As one non-limiting example, the wedge 146 may be used to position one or more of the thumb 130 and the first, second, third, and fourth fingers 132, 134, 136, 138 in a desired position relative to one another or relative to a palm of the hand. The wedge 146 may be any suitable size, shape, and configuration, as determined by one of skill in the art. In certain embodiments, a rigid or semi-rigid material such as plastic, rubber, or silicone, as non-limiting examples, may be used to form the wedge 146. The wedge 146 may be integral with or permanently or removably attached to the glove 102. Any suitable means for connecting the wedge 146 to the glove 102 in a desired position may be used, as desired. In certain embodiments, the wedge 146 may be configured to move to one or more desired locations on the glove 102, as determined by the user. It should be appreciated that the wedge 146 may be separate from the glove 102 and adapted to directly connect to one or more of the thumb 130 and the first, second, third, and fourth fingers 132, 134, 136, 138 of the user, independent from the glove 102, in certain embodiments.

In a more particular embodiment, the wedge 146 may be disposed between the first finger receptacle 120 and the second finger receptacle 122. More particularly, in certain embodiments, the distal ends 116 of the first finger receptacle 120 and the second finger receptacle 122 may each have an outer surface 148 including a wedge receiving element 150 for receiving the wedge 146. In a more particular embodiment, the wedge 146 may have a wedge connecting means 152 disposed on one or both sides of the wedge 146, the wedge connecting means 152 adapted to engage with the wedge receiving element 150 on each of the first and second finger receptacles 120, 122.

It should be appreciated that, in certain more particular embodiments, the wedge 146 may be configured to create a predetermined distance 154 between the first finger 132 and the second finger 134. The predetermined distance 154 may be determined, for example, by the three-finger shot training method for basketball, as one non-limiting example. The predetermined distance 154 may allow the user to develop a proper shooting form. It should be further appreciated that cooperation of the first and second finger receptacles 120, 122 in combination with the wedge 146 may militate against the first finger 132 and the second finger 134 sliding too far apart and too close together, during use. A skilled artisan may select any suitable wedge 146 having any desired size, shape, and configuration in combination with the glove 102, as determined by the end use of the glove 102.

In certain embodiments, the glove 102 may include or be configured to receive a palm riser 156. The palm riser 156 may be fabricated using any suitable material. In certain embodiments, as non-limiting examples, the palm riser 156 may be a made using a rigid or semi-rigid material such as plastic, rubber, or silicone. Alternatively, in certain embodiments, the palm riser 156 may be made using a flexible component such as a packet filled with any suitable material such as a gel or liquid, or an inflatable packet filled with air, as non-limiting examples. Advantageously, the palm riser 156 may aid the user by positioning the ball 140 or other sporting equipment at a predetermined location on the shooting hand of the user. As one non-limiting example, in a more particular embodiment of the present disclosure, the palm riser 156 may position the ball 140 higher up on the palm of the user's hand. In certain embodiments, the location of the palm riser 156 may be movable and adjustable on the main body 104 of the glove 102, and, where the palm riser 156 is removable, it should be appreciated that the user may remove the palm riser 156, as desired. In certain embodiments, the palm riser 156 may be integral with the glove 102. A skilled artisan may select any suitable palm riser 156 according to the end use of the glove 102.

In certain more particular embodiments, as shown in FIG. 1, the palm riser 156 may be received by a pocket 158 formed in the palm portion 106 of the glove 102. The pocket 158 may be a slit, an opening, a cavity, a removable strap, a mesh or flexible covering, or any other suitable component adapted to receive the palm riser 156.

According to certain embodiments, the main body 104 of the glove 102 may include a sleeve 160. The sleeve 160 may extend along the wrist and/or the forearm of the user. In certain embodiments, the sleeve 160 may be fabricated from a flexible, semi-rigid material, a stretchable material, or a combination of materials. Desirably, the material may be lightweight, durable, and resistant to tears. According to certain embodiments, the material may have antimicrobial properties. As a non-limiting example, copper may be woven into the material in order to provide the antimicrobial properties. As another non-limiting example, in certain embodiments, the material of the sleeve 160 may be treated with an antimicrobial product. The material of the sleeve 160 may be breathable and easy to clean according to certain embodiments. Materials including silicon, plastic, rubber, cotton, spandex, nylon, polyester, polyester-vinyl, vinyl, and/or rayon may be used to fabricate the sleeve 160. The sleeve 160 may be formed from solid material, material having one or more openings, mesh material, or any desirable combination of materials, weaves of material, and openings. A skilled artisan may select any suitable material or combination of materials for the sleeve 160, as desired. The sleeve 160 may be integral with the main body 104 of the glove 102, or removably connected to the main body 104 of the glove 102.

In certain embodiments, the sleeve 160 may have one or more fit adjusting mechanisms 110 for adjusting the size of the sleeve 160 to fit the user's wrist and forearm. As non-limiting examples, an adjustable strap, flap, zipper, button, elastic element, hook-and-loop, tie, or other adjustable fit adjusting mechanism 110 may be used to tighten or more securely fasten or hold the sleeve 160 on the wrist and forearm, as desired. Likewise, in certain embodiments, a gripping surface or other textured surface may be disposed on or integral with a portion of the sleeve 160, for example, an inner surface (not shown) of the sleeve 160, in order to hold the sleeve more securely 160 on the user's wrist and forearm.

In certain embodiments, and with reference now to FIGS. 1, 3, 5A, and 5B, the sports training device 100 may include one or more sensors 162. The sensor 162 may be configured to monitor one or more specific movements during the training session. Likewise, the sensor 162 may be configured to evaluate contact with the ball 140 or other sporting equipment during the training session. As one non-limiting example, the sensor 162 may be configured to determine a number of shots taken during the training session. It should be appreciated that the sensor 162 may be integral with the glove 102 or removably or permanently attached to the glove 102. Likewise, where more than one sensor 162 is used, certain sensors 162 may be in communication with one another and certain sensors 162 may operate independently from one another. In certain embodiments, the sensor 162 may be positioned and repositioned by the user according to a desired end use of the glove 102 or the specific movements to be monitored. A person skilled in the art may select any suitable sensor 162 or combination of sensors 162, for example, the sensor 162 can include one or more inertial sensors for measuring an inertial measurement unit (IMU), and which are capable of detecting a position of the user's hand, wrist, and forearm during specific movements. The sensor 162 may include one or more gyroscopes, accelerometers, magnetometers, and/or any other suitable components used to measure various aspects of the user's hand, wrist, and forearm position, specific movements, and interactions with the ball 140 or other sporting equipment. As non-limiting examples, single sensors 162 or combinations of sensors 162 can include BNO055 IMU sensors and/or VCNL4040 proximity sensors, available from Adafruit Industries (New York, NY) may be used. In certain embodiments, one or more of the sensors 162 may be housed in a sensor case (not shown) adapted to protect the sensors 162 while the glove 102 is being used.

In certain embodiments, as shown in FIG. 1, a third finger sensor 164 may be disposed on the third finger receptacle 124 and a fourth finger sensor 166 may be disposed on the fourth finger receptacle 126 in order to monitor whether and to what extent the third and fourth fingers 136, 138 of the user are contacting the ball 140 or other sporting equipment during a training session or, more particularly, a specific movement. In yet another embodiment (not shown), a thumb sensor may be disposed on the thumb receptacle 118, a first finger sensor may be disposed on the first finger receptacle 120, and a second finger sensor may be disposed on the second finger receptacle 122. The first, second, and third finger sensors may monitor when the basketball is released from each of the thumb 130 and the first finger and second fingers 132, 134, relative to a movement of the user's wrist. Additionally, the thumb sensor and first and second finger sensors may also monitor the contact between the user and the ball 140 or other sporting equipment, and advantageously, the thumb sensor and the first and second finger sensors may provide feedback as to how accurately the user is utilizing the three-finger shot method.

In certain embodiments, the glove 102 may include sensors 162 adapted to monitor an alignment of one or more of the hand, the wrist, the forearm, and an elbow of the user, as well as a position of the hand and wrist of the user relative to one another at various points throughout the release of the object by the user (e.g., a basketball shot) or other specific movement or action. In certain more particular embodiments, a first movement sensor 168 may be disposed adjacent one or both of the proximal ends 114 of the first and second fingers 132, 134 of the user. The first movement sensor 168 may be adapted to determine a position of the user's hand relative to a second movement sensor 170. In certain more particular embodiments, the second movement sensor 170 may be disposed on or in the glove 102 adjacent the wrist or the forearm of the user such that the alignment and position of the hand relative to the wrist, the forearm, and the elbow may be determined at various points throughout a training session, or more specifically, during and through the release of the object by the user, such as when making a shot with a basketball, or other specific movement or action.

In a more particular embodiment, a first relative angle 172 may be measured using the first movement sensor 168 and the second movement sensor 170 when the user's hand rotates backwards prior to releasing the ball 140 or other sporting equipment, and a second relative angle 174 may be measured using the first movement sensor 168 and the second movement sensor 170 when the user's hand rotates forwards during or after releasing the ball 140 or other sporting equipment. It should be appreciated that any relative angle may be measured between any two or more sensors disposed on the glove 102 during any desired action or specific movement for which the user would like feedback.

In certain embodiments, one or more sensors 162 included with the glove 102 may use Euler angles to display one or more relative angles between two body parts, for example, the fingers and the wrist of the user. More specifically, a relative angle anywhere up to a greatest point of flexion, as shown in FIG. 5A, and a relative angle anywhere up to a greatest angle of extension, as shown in FIG. 5B, may be measured. Relative angles showing different lateral bending angles, rotation of the hand and wrist, movement of the fingers, and any other desired movement may also be measured using sensors 162 on the glove 102, as desired by the end use of the glove. Relative angles showing ranges of motion may be measured between the forearm and the hand of the user and the wrist and the hand of the user, as non-limiting examples. Additionally, quaternions may be used to represent orientations and track relative angles between the sensors 162 on the glove 102. Quaternions may describe a "hyper-sphere", or four-dimensional object that may describe an orientation of the user's hand, wrist, and forearm in a three-dimensional space. Coordinate x, y, and z components refer to an axis about which a rotation will occur along with a "w" component which represents magnitude of rotation about the described axis. Common terms describing these x, y, z, and w components may include vectors and floats. The four components are combined to create a matrix. In a quaternion matrix, the three axis will have both a real and imaginary component. The imaginary number "i" may be defined as the square root of negative one and in this methodology there are three distinct imaginary numbers i=j=k=square root(−1). A symbolic example of a quaternion matrix is defined as q=w+xi+yj+zk, where w, x, y, and z are real numbers. Matrix quaternions are defined in the following format (w, x, y, z), where w is the magnitude of rotation about the axis defined by <x, y, z>. According to certain embodiments, quaternions for a first sensor and a second sensor (not shown) may be compared and the relative quaternions describing the angle between them may be defined. Additionally, the relative quaternions may be translated into Euler angles such that they may be easily understood by the user during evaluation of a training session.

It should be appreciated that the present disclosure contemplates the use of a variety of different configurations for one or more sensors 162, which may be determined by the movement to be monitored and the end use of the glove 102. A skilled artisan may select any suitable number and configuration for the sensor 162, as desired.

Figure 6:
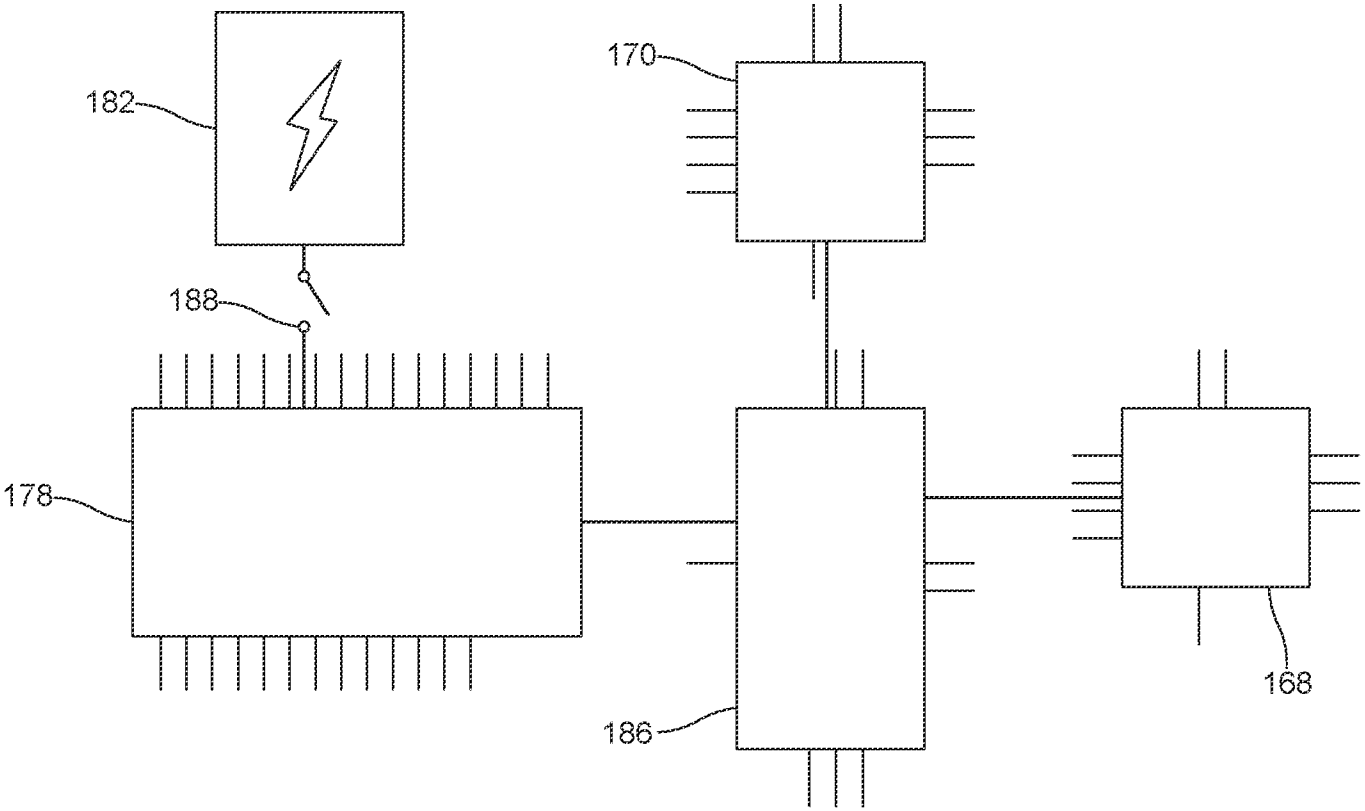
FIG. 6 is a schematic view of a portion of a sports training device according to another embodiment of the present disclosure.

With reference now to FIG. 6, the sensor 162 may be in communication with an electronic controller 178 using one or more wires 176. Alternatively, in certain embodiments, the sensor 162 may be in communication with the electronic controller 178 using a wireless connection (not shown). The controller 178 may be configured to receive signals from the sensor 162 and provide feedback to the user. Additionally, the controller 178 may provide feedback to the user independent from the sensor 162, for example, a timer function. It should be appreciated that the controller 178 may include any other desirable functions as determined by one skilled in the art.

In certain embodiments, the controller 178 may be a microprocessor or microcontroller including a processor, memory, and input and output peripherals. It should be appreciated that a skilled artisan may select any suitable controller 178 having any suitable components adapted to measure and record various aspects of a training session, as desired. The controller 178 may include code developed for measuring and evaluating various functions and specific movements of the glove 102. As one non-limiting example, Arduino code may be used. The controller 178 alone or in combination with the sensors 162 may, for example, accurately count and evaluate one or more data points or a set of data relating to one or more of shots, throws, passes, and dribbles, measurement wrist and elbow orientation, and determine various characteristics of a set up and release of a shot, throw, and other releasing movement such as release time and ball 140 to hand and finger contact. In certain more particular embodiments, the controller 178 may be calibrated by the user to determine a good versus a bad shot at various locations on a court for example, a free throw line, a three-point line, and a jump shot location. In certain embodiments, the controller 178 may be calibrated in a standardized way such that the user does not need to program and adjust the controller 178 prior to using the glove 102.

In certain embodiments as shown in FIG. 5A, the controller 178 may be housed in a case 180. The case 180 may be a wearable case 180 fabricated from a light, durable, and protective material. In certain embodiments, the case 180 may be 3D printed. The case 180 housing the controller 178 may be permanently or removably attached to the any desired portion of the glove 102 such as the sleeve 160 adjacent the wrist or forearm of the user using any suitable means. It should be appreciated that, in certain embodiments, placement of the case 180 outside of the glove 102 may allow for easy access to and removal of the controller 178 should repairs need to be made or replacement of parts be required. In certain embodiments, the controller 178 may be housed inside a portion of the glove 102, as shown in FIG. 5B, such as inside of the sleeve 160 adjacent the wrist or the forearm of the user, as non-limiting examples. The controller 178 may be housed in the case 180, and the case may be disposed inside of the glove 102. Alternatively, the controller 178 may not be housed in the case 180, and may be housed directly in the glove 102, according to certain embodiments of the present disclosure, as desired.

The controller 178 may include a power source 182 according to certain embodiments of the present disclosure. As non-limiting examples, one or more batteries or rechargeable batteries may be removably connected or soldered to the controller 178 to provide the power source 182. In certain embodiments including a rechargeable power source 182, the power source 182 may be in communication with a power charging mechanism 184. As one non-limiting example, a USB connection may be used to charge the power source 182. It should be appreciated that any suitable charging mechanism 184 may be used, as determined by one of skill in the art.

The feedback provided by the controller 178 may be presented to the user by way of a visual interface 186, according to certain embodiments of the present disclosure. As shown in FIG. 3, the visual interface 186 may be disposed on the glove 102, for example, on one or more of the back portion 108 of the sleeve 160 adjacent the wrist or the forearm of the user, as non-limiting examples, and is in communication with the controller 178. The visual interface 186 may include an LCD display, LED lights, and any other suitable means for displaying the feedback from the controller 178 to the user. As non-limiting examples, the visual interface 186 may light up green when the user has properly performed a shot or other specific movement according to various parameters such as orientation of the hand and the wrist, forearm, and elbow of the user and desired contact between the glove 102 and the ball 140 or other sporting equipment, for example. Likewise, the visual interface 186 may light up red when the user has not properly performed the shot or other specific movement. Additional feedback may be provided in the form of sounds, vibrations, digital readouts, and any other suitable means, as determined by one of skill in the art.

One or more activation mechanisms 188 may be included on the glove 102 and adapted to activate one or both of the controller 178 and the visual interface 186, as desired by the user. Additional activation mechanisms (not shown) in the form of buttons or other suitable components may be included on one or more of the glove 102, the visual interface 186, and the controller 178 and may be used to, as non-limiting examples, calibrate the settings of the sports training device 100, turn on and off desired functions of the sports training device 100, activate one or more sensors 162, as desired, and customize the functions of the glove 102 for a specific movement or task, such as dribbling, shooting, throwing, passing, and otherwise maneuvering and releasing the ball 140 or other sporting equipment. One skilled in the art may include any type, number, and configuration of activation means for calibrating the sports training device 100 and activating and monitoring various functions of the sports training device 100, as desired.

Figure 7:
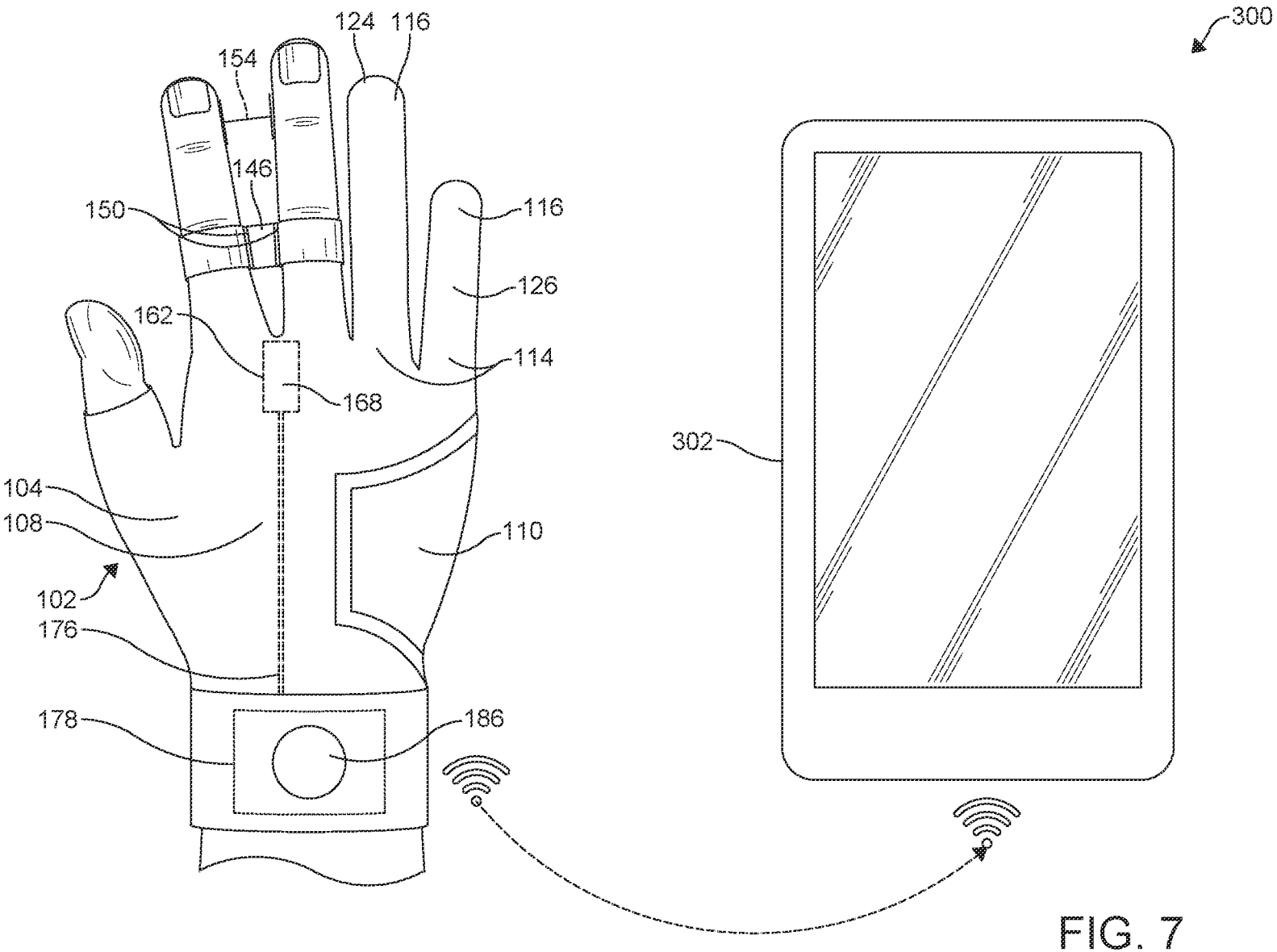
FIG. 7 is a front elevational view of a sports training system according to another embodiment of the present disclosure.

In yet another embodiment, with reference now to FIG. 7, a sports training system 300 for recording and evaluating data and feedback from the sports training device 100 during a training session may include the sports training device 100 and a remote device 302. As non-limiting examples, the remote device 302 may be one or more of a mobile telephone, a tablet, and a computer. It should be appreciated that any remote device 302 may be used for evaluating the data and feedback provided by the sports training device 100. It should be further appreciated that, in certain embodiments, the user may obtain all necessary and desired data and feedback from the visual interface 186 disposed on the glove 102.

In certain embodiments, the controller 178 may be connected to one or more of an internet cloud and the remote device 302 using wireless transmissions such as Bluetooth®. In certain embodiments, the sports training device 100 may connect to one or more of Wi-Fi hotspots and Wi-Fi and cellular networks, as desired. The remote device 302, using an application or other computer programming, may receive and evaluate data and feedback from the controller 178 and provide additional feedback, for example, more detailed feedback, about the training session in a user-friendly format. Advantageously, the user may be able to track a progression of the training sessions and compare data and feedback from more than one training session, as desired, in order to evaluate any trends, inconsistencies, and improvements over a period of time.

In certain more particular embodiments, the sports training system 300 may include a remote sensor or other remote data-collecting device or controller unit on one or more of a second user, a basket, a goal, and a backboard, as non-limiting examples (not shown). The remote sensor or other remote data-collecting device or controller unit may be in communication with the remote device 302 and provide another reference point for evaluating one or more of the shot or other specific movement of the user and a location of the ball 140 or other sporting equipment. For example, in certain more particular embodiments of the sports training system 300, reference points and data collected from the sports training device 100 and the remote sensor or other remote data-collecting device or controller unit may provide a complete set of data detailing the movements of the user, the movement of the ball 140 or other sporting equipment, the outcome of the shot or release of the ball 140 or other sporting equipment, for example, whether the ball travels through the basket, and the time it takes for the set up and completion of the shot or other specific movement and action. Likewise, in certain embodiments, the ball 140 or sporting equipment may include a remote sensor or other remote data-collecting device or controller unit, as desired, to provide yet another reference point for evaluating one or more of the shot or other specific movement of the user and a location of the ball 140 or other sporting equipment. In yet another embodiment, the sports training system may include a video recording function on one or more of the sports training device 100, the user, the ball 140 or other sporting equipment, the remote sensor or other remote data-collecting device or controller unit, the remote device 302, or any other suitable item or data collection device or mechanism, as desired. Data and feedback from each point of data collection may then sync, allowing the user to see a complete picture of the shot or specific movement or action taken for evaluation and improvement. In certain embodiments, the application or computer programing may collect data and feedback during one or more training sessions and use the data to train and optimize machine learning as a part of the application or computer programming.

In a more particular embodiment, the sports training system 300 may include a feather microcontroller 178 charged by lithium-ion battery power source 182 having direct wires 176 connecting to BNO055 sensors 162 while still containing a Wi-Fi module. In another embodiment, an Adafruit Feather Circuit Python board may be used, as provided by Adafruit Industries (New York, NY). In yet another more particular embodiment of the present disclosure, the controller 178 is a microcontroller that connects two sensors 162 in series using the power source 182 and ground wires 176, as well as SDA and SCL wires 176. One or more of the sensors 162 may have power wired to an address pin in order to change a 12C address given by one or more of the sensors 162.

In operation, according to certain embodiments of the present disclosure, the user may place the glove 102 on the shooting or throwing hand in order to practice a specific action or movement, for example, the three-point shot. Depending on the specific needs of the user, the user may place the third finger 136 and the fourth finger 138 in the finger anchor 142, utilize the wedge 146, insert or remove the palm riser 156, and adjust the fit of the glove 102 using the fit adjusting mechanism 110, as desired. Next the user may activate the controller 178 and the visual interface 186 using the one or more activation mechanisms 188 in order to observe feedback throughout the training session. If needed, the user may select from various functions and parameters using the visual interface 186 prior to beginning the training session. As one non-limiting examples, the user may select to obtain feedback about shooting a basketball. If needed, the user may take one or more practice shots in order to calibrate the sports training device 100, as needed. When ready, the user may begin the training session. The sensors 162 and controller 178 may continuously obtain data based on the movement and the actions of the user throughout the training session. The controller 178 may provide real-time feedback from the glove 102 by way of the visual interface 186, for example, after each shot. The user may adjust their shot according to the feedback provided by the sports training device 100.

The sports training device 100 may be charged, according to certain embodiments of the present disclosure, by connecting the device to the charging mechanism 184, for example, a USB power charging mechanism. A level of charge of the power source 182 at any given time may be made known to the user by way of an indication on the visual interface 186. In certain embodiments, a storage bag (not shown) may be included and stored in the pocket 158 of the glove 102 and adapted to store the glove 102 when not in use. The wedge 146 and any other loose parts may also be stored in the pocket 158 when the glove 102 or the wedge 146 are not in use.

In operation, according to a more particular embodiment of the present disclosure, the user may turn on the sports training device 100 using the activation mechanism 188. The controller 178 may then begin loading the code or programming, for example, Python code. After initialization, the visual interface 186 may load a splash screen for a predetermined period of time followed by instructions for the user and options for changing settings or other functions of the sports training device 100. There may also be a manual initialization that includes sensor calibrations or wireless connection setup, according to certain embodiments of the present disclosure. The sports training device 100 may include any number of functions and tracking methods for the user to select including, but not limited to, shot counting, wrist orientation tracking, ball to hand contact detecting, good versus bad form feedback, timing of release, and timing of training session. The visual interface 186 may also display information relating to the sensors 162, settings for the sports training device 100, setup functions of the sports training device 100, timer functions, user settings, user profile settings, selection of shot type or actions to be monitored, sensor calibration functions, and training session goals and achievements, as non-limiting examples. The sports training device 100 may be adapted to notify the user throughout the training session if certain goals or milestones are reached. Training feedback displayed on the visual interface 186 may inform the user whether all data points being evaluated fall within a predetermined, acceptable range, or in an unacceptable range, according to certain embodiments of the present disclosure, thereby notifying the user whether the shot was good or bad, for example, using a green light and a red light notification system. As another non-limiting example, a preset, acceptable range or wrist flexion and extension may be calibrated such that a user will be informed after a shot as to whether the wrist movement and orientation was in an acceptable range. In certain embodiments, the controller 178 will be refined to calibrate good vs bad shots, for example, from a free-throw line based on predetermined and preset criteria, as desired. Advantageously, the user can expect that their basketball shooting biomechanics, for example, hand to ball contact at release time and elbow and wrist orientation, may improve over time as a result of the feedback supplied by the sports training device 100.

Figure 4:
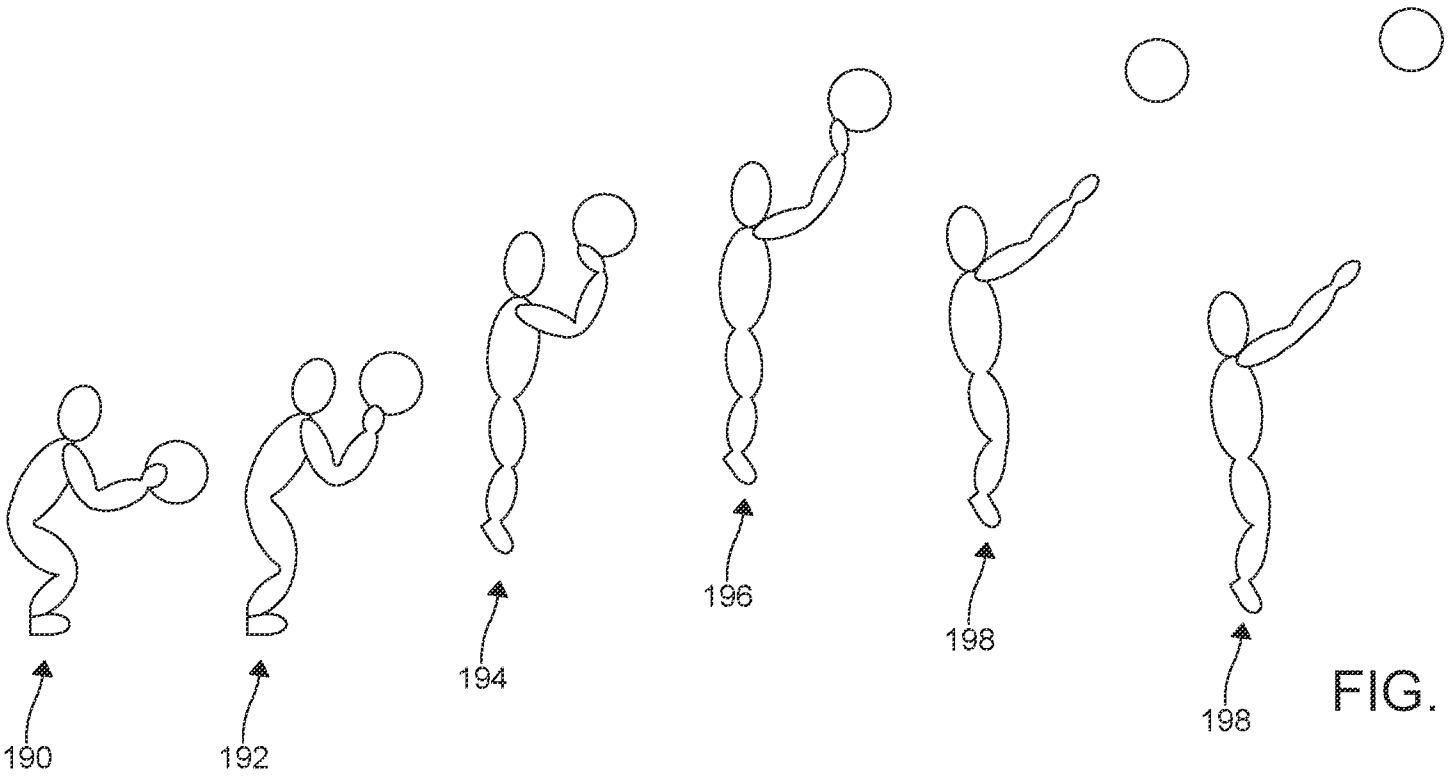
FIG. 4 is a series of side elevational views of a user performing a series of movements to be recorded by a sports training device according to another embodiment of the present disclosure.

In certain more particular embodiments, the user may monitor and receive feedback about a shot or release of an object from a start to a finish. As one non-limiting example, with reference to FIG. 4, the sports training device 100 may collect feedback from the sensors 162 at the start and the finish of a user's free-throw shot, as well as throughout the shot. Data such as wrist orientation, wrist rotation, contact with the ball 140, and time of release, may be collected during each of a preparation phase 190 of the user's shot, a ball elevation phase 192, a stability phase 194, a release phase 196, and an inertia phase 198, as one non-limiting example. In a more particular embodiment, with renewed reference to FIG. 4, the first movement sensor 168 and the second movement sensor 170 may provide data to the controller 178 with respect to the first relative angle 172, the second relative angle 174, and a plurality of relative angles in between as the user performs the specific action from start to finish. According to certain embodiments, data may be collected and stored by the controller 178 at a rate of 100 points of data per second.

It should be appreciated that the user may, in operation, obtain data and feedback from the remote device 302 when using the sports training system 300, according to certain embodiments of the present disclosure. The user may set up the glove 102, as desired, as well as any remote sensors or other remote data-collecting devices or controller units in order to collect data during a training session. Data may be wirelessly transmitted to the remote device 302 and presented to the user as a series of data points, for example, in a graph or other display. A complete picture of the training session, as well as a breakdown of a plurality of movements and actions, may be obtained using sports training system 300. In certain embodiments, a microSD card, or other means for storing data may be removed from the sports training device 100 and downloaded to a remote device 302, if needed.

Figure 8:
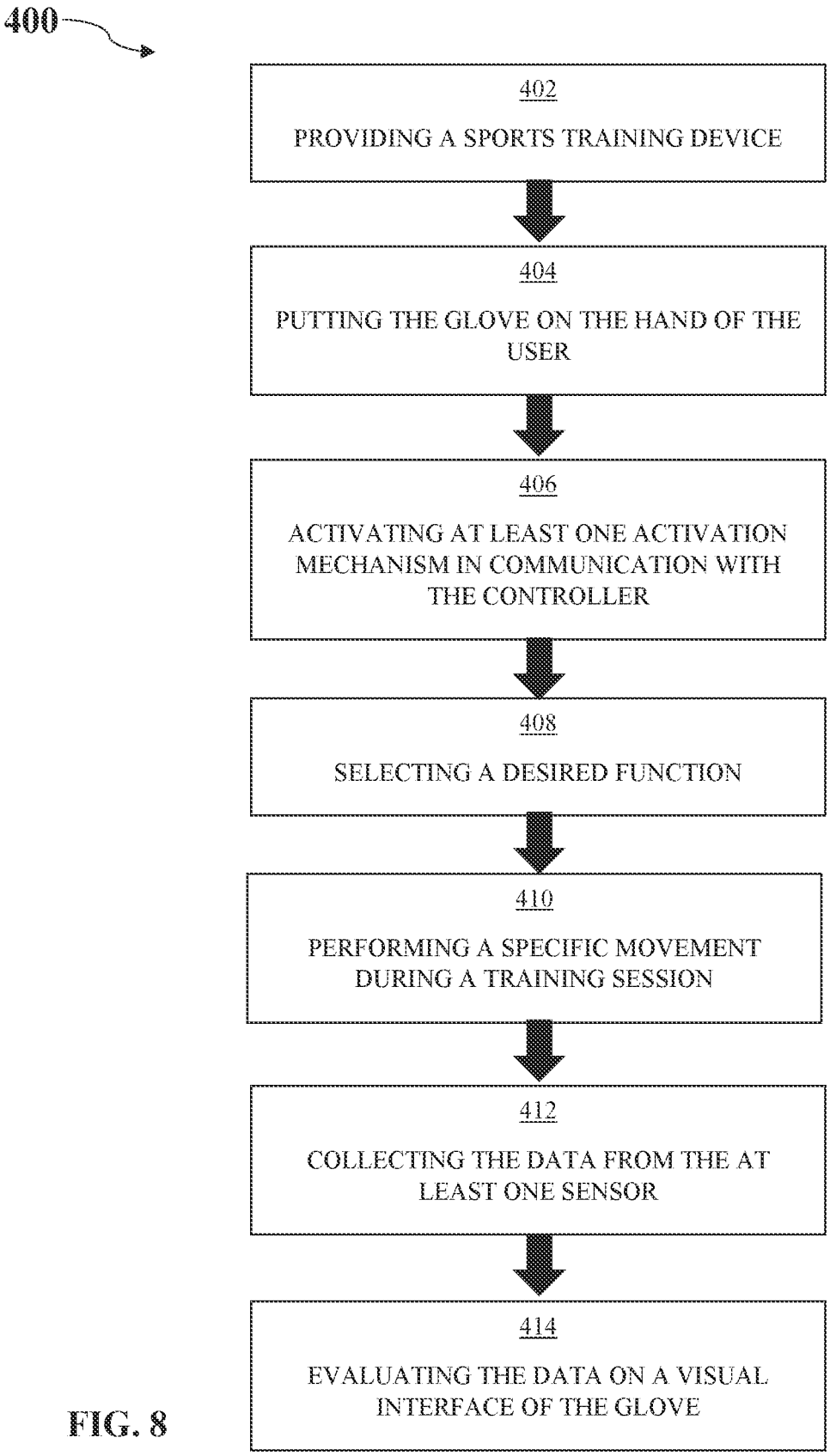
FIG. 8 is a method of improving release of an object by a hand of a user according to another embodiment of the present disclosure.

In yet another embodiment of the present disclosure, with reference to FIG. 8, a method 400 of improving a shot, throw, or other specific action or actions during a training session, according to various embodiments, is shown. The method 400 of improving the shot, throw, or other specific action or actions may include a first step 402 of providing the sports training device 100. The method 400 may further include a second step 404 of putting the glove 102 on the hand of the user. A third step 406 may include activating one or more of the activation mechanisms 188 on the glove 102. In a next step 408, the user may select any desired function or functions of the sports training device 100 to be used during the training session to collect and process data. In a next step 410, the user may perform various specific movements and actions throughout the training session. In yet another step 412, data may be collected throughout the training session by the sports training device 100 and displayed on the visual interface 186 of the glove 102. In yet another step 414, the user may evaluate the data being displayed on the visual interface 186 of the sports training device 100 in order to improve various aspects of the user's shot, throw, or other specific action or actions during the training session.

It should be appreciated that the user may need to perform additional steps, according to various embodiments of the present disclosure. As non-limiting examples, additional steps may include charging the sports training device 100, adjusting the glove 102, as needed, and calibrating the sports training device 100. It should also be appreciated that, according to certain embodiments, a method (not shown) of improving the shot, throw, or other specific action or actions during the training session may include providing the sports training system 300 and evaluating data from one or more remote sensors or other remote data-collecting devices or controller units and evaluating the data using the remote device 302.

In certain embodiments, method of improving a release of an object by a hand of a user are provided that may employ various embodiments of the sports training devices 100 as described herein. Such methods may include putting the glove 102 on the hand of the user. The controller 178 may then receive a set of data from the sensor 168 and the controller 178 may determine if the set of data falls in a predetermined category. The predetermined category may include an acceptable range and an unacceptable range, where such ranges may be user modifiable and/or include predetermined thresholds. The sports training device 100 may then display whether the set of data is in the acceptable range or the unacceptable range on the visual interface 186.

It should be further appreciated that, although the sports training device 100 and the sports training system 300 of the present disclosure are often described in relation to shooting a basketball, the present disclosure contemplates additional uses for a variety of sport activities. For example, the sports training device 100 and the sports training system 300 may be used to evaluate the user's dribbling, passing, throwing, releasing, striking, or otherwise performing a specific action during the training session. End uses for the sports training device 100 and the sports training system 300 may include sports such as baseball, softball, football, tennis, frisbee, bowling, and disc throwing, as non-limiting examples. The sensors 162, the controller 178, and any remote sensors or other remote data-collecting devices or controller units may be configurable to the desired sport and sporting equipment, as desired. Accordingly, the feedback provided to the user may be tailored based on the action performed. As non-limiting examples, the sports training device 100 and the sports training system 300 of the present disclosure may be utilized to train the user for baseball, softball, bowling, disc golf, or any other activity where it may be beneficial to monitor the control and release of the ball 140 or other sporting equipment to be thrown or released for training purposes.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, components and methods can be made within the scope of the present technology, with substantially similar results.

What is claimed is:

1. A sport training system, comprising:

a glove to be worn on a hand of a user, the glove having:

a main body having a palm portion and a back portion, the main body configured to receive the hand of the user;

a plurality of finger receptacles disposed on the main body, each finger receptacle of the plurality of finger receptacles having a proximal end disposed adjacent to the main body and a distal end disposed opposite the proximal end, the plurality of finger receptacles including a thumb receptacle, a first finger receptacle, and a second finger receptacle; and a finger anchor disposed on the palm portion of the glove, the finger anchor configured to secure a finger in a predetermined position for using the glove;

a sensor configured to monitor a movement of the hand of the user; and a controller in communication with the sensor, the controller configured to receive a set of data from the sensor and determine if the set of data falls in a predetermined category, wherein the controller is configured to display whether the set of data is in the predetermined category to the user on a visual interface.

2. The sports training system of claim 1, wherein the glove includes a sleeve configured to be positioned adjacent one of a wrist of the user and a forearm of the user.

3. The sports training system of claim 2, wherein the controller and a visual interface are disposed in one of the main body of the glove and the sleeve of the glove.

4. The sports training system of claim 3, wherein the controller is in communication with the sensor using a wire connection.

5. The sports training system of claim 4, wherein a first movement sensor is disposed adjacent to a member selected from the group consisting of the thumb receptacle, the first finger receptacle, and the second finger receptacle.

6. The sports training system of claim 5, wherein a second movement sensor is disposed in the sleeve adjacent one of the wrist of the user and the forearm of the user.

7. The sports training system of claim 6, wherein the controller is configured to measure a first relative angle using a position of the first movement sensor relative to the second movement sensor when the hand of the user is in a flexed wrist position.

8. The sports training system of claim 7, wherein the controller is configured to measure a second relative angle using the position of the first movement sensor relative to the second movement sensor when the hand of the user is in an extended wrist position.

9. The sports training system of claim 8, wherein the first movement sensor and the second movement sensor are configured to transmit a set of data to the controller and the controller is configured to display the set of data on the visual interface.

10. The sports training system of claim 4, further comprising a third finger receptacle and a fourth finger receptacle, each of the distal end of the third finger receptacle and the distal end of the fourth finger receptacle being covered.

11. The sports training system of claim 10, wherein a third finger receptacle sensor is disposed at the distal end of the third finger receptacle and a fourth finger receptacle sensor is disposed at the distal end of the fourth finger receptacle.

12. The sports training system of claim 11, wherein the third finger receptacle sensor and the fourth finger receptacle sensor are configured to transmit a set of data to the controller and the controller is configured to display the set of data to the user on the visual interface.

13. The sports training system of claim 1, wherein the glove is configured to selectively receive a wedge between the first finger receptacle and the second finger receptacle.

14. The sports training system of claim 1, wherein the glove is configured to selectively receive a palm riser on the palm portion of the glove.

15. The sports training system of claim 14, wherein the palm riser is removably housed in a pocket disposed on the palm portion of the glove.

16. The sports training system of claim 1, wherein the finger anchor comprises one or more loops adjacent to a third finger receptacle and a fourth finger receptacle of the glove.

17. The sports training system of claim 1, further comprising a remote device adapted to receive a set of data from the controller.

18. The sports training system of claim 17, wherein the remote device is configured to display the set of data received from the controller.

19. A method of monitoring a sport training session, the method comprising the steps of:

providing a sport training system, the sport training system having a glove, the glove having a main body having a palm portion and a back portion, the main body configured to receive a hand of a user, a plurality of finger receptacles disposed on the main body, each finger receptacle of the plurality of finger receptacles having a proximal end disposed adjacent to the main body and a distal end disposed opposite the proximal end, the plurality of finger receptacles including a thumb receptacle, a first finger receptacle, and a second finger receptacle, a finger anchor disposed on the palm portion of the glove, the finger anchor configured to secure a finger in a predetermined position for using the glove, a sensor, the sensor configured to monitor a movement of the hand of the user, and a controller in communication with the sensor, the controller configured to receive a set of data from the sensor and determine if the set of data falls in a predetermined category, wherein the controller is configured to display whether the set of data is in the predetermined category to the user on a visual interface;

putting the glove on the hand of the user;

receiving, by the controller, a set of data from the sensor;

determining, using the controller, if the set of data falls in a predetermined category, and displaying whether the set of data is in the predetermined category.

20. The sports training system of claim 1, wherein the distal end of the thumb receptacle, the distal end of the first finger receptacle, and the distal end of the second finger receptacle terminate on a portion of a finger of the user.

* * * * *